United States Patent [19]

Demetrescu

[11] 3,995,427

[45] Dec. 7, 1976

[54] MULTIPLE-PHASE COMBUSTION ENGINE EMBODYING HYDRAULIC DRIVE

[75] Inventor: Mihai C. Demetrescu, Irvine, Calif.

[73] Assignee: Resonance Motors, Inc., Monrovia, Calif.

[22] Filed: May 15, 1975

[21] Appl. No.: 577,801

[52] U.S. Cl. ..... 60/595; 137/625.21

[51] Int. Cl.[2] ..... F02B 71/04

[58] Field of Search ..... 60/325, 369, 416, 537, 60/544, 581, 595, 668, 698, 701, 719; 137/625.12, 625.21

[56] References Cited

UNITED STATES PATENTS

| | | | |
|---|---|---|---|
| 3,088,413 | 5/1963 | Johnson | 60/595 X |
| 3,295,451 | 1/1967 | Smith | 60/537 X |
| 3,365,879 | 1/1968 | Panhard | 60/595 |

*Primary Examiner*—Edgar W. Geoghegan
*Attorney, Agent, or Firm*—Nilsson, Robbins, Dalgarn & Berliner

[57] ABSTRACT

A power system is disclosed for use as an automotive drive engine, utilizing combustible fuel and hydraulic drive. A multiple-phase engine, incorporating three piston units, burns fuel to provide alternating-pressure tri-phasic hydraulic energy in three lines. The engine is resonant in operation, i.e. all parts move in a rectilinear mechanically-resonant motion pattern and a constant positional phase relationship is preserved between the engine pistons by a single hydraulic mechanism. As disclosed, the tri-phasic hydraulic energy is applied to a dynamic valve unit for conversion into a unidirectional hydraulic power stream that is applied to actuate one or more hydraulic motors. In the described embodiment, the valve unit is driven by a synchronous electrical motor which is phase varied in relation to the operating phase of the engine by a control unit that regulates the entire system for response to manual commands. The central logic or control unit receives manual command data as well as system data, e.g. data on the pressure differential across a hydraulic motor and the resonant motion amplitude of piston units. The data applied to the control unit regulates: a fuel modulator for selectively supplying fuel to the engine, a fluid bypass apparatus for absorbing energy (as during braking), and the dynamic valve for converting energy as well as supervising the flow path of energy either from the engine to the motor or from the motor to the engine. Thus, the system is controlled whereby a balance is maintained between: (1) the average energy provided discontinuously by active combustion cycles of the resonant engine and (2) the energy extracted continuously from the engine to drive one or more hydraulic motors. Accordingly, fuel flow is modulated to maintain resonant operation of the engine and supply power demands. During deceleration, the hydraulic motors function as pumps, driving the engine through the valving unit to attain and maintain fulldisplacement resonant operation. In the event additional deceleration is desired, the motor (functioning as a pump) is loaded by a hydraulic energy absorber. As disclosed, the system is illustratively embodied in an automobile.

18 Claims, 14 Drawing Figures

BY-PASS-ENERGY ABSORBER
CENTRAL LOGIC UNIT
FUEL MODULATOR
FUEL SUPPLY
STARTING UNIT
EXHAUST
FEED-BACK
EXHAUST
AIR
ΔP
M
10
11
12
14
16
18
20
22
24
25
26
28
30
32
34
36
40
41
42
308
C
E
V

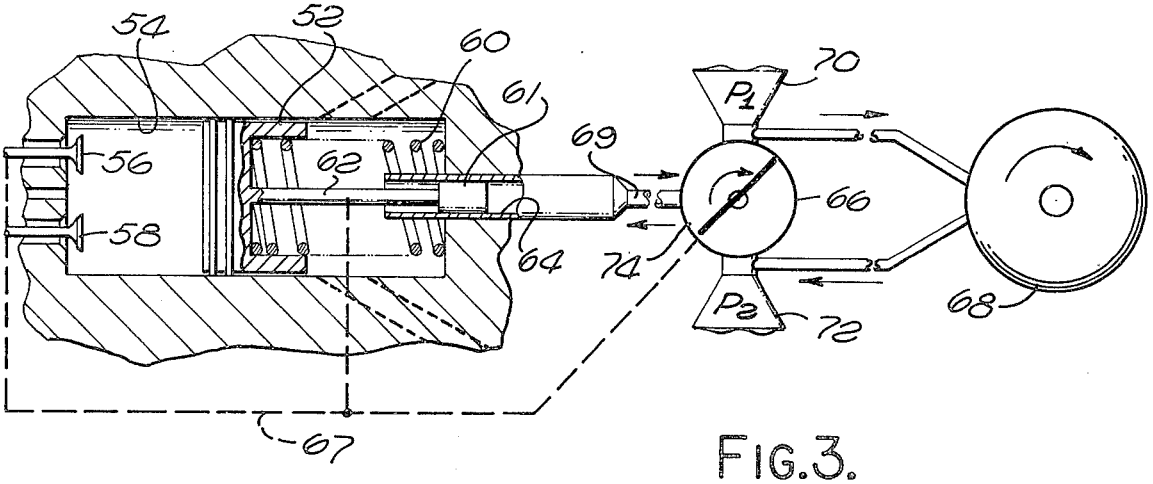
FIG. 3.
FIG. 2.
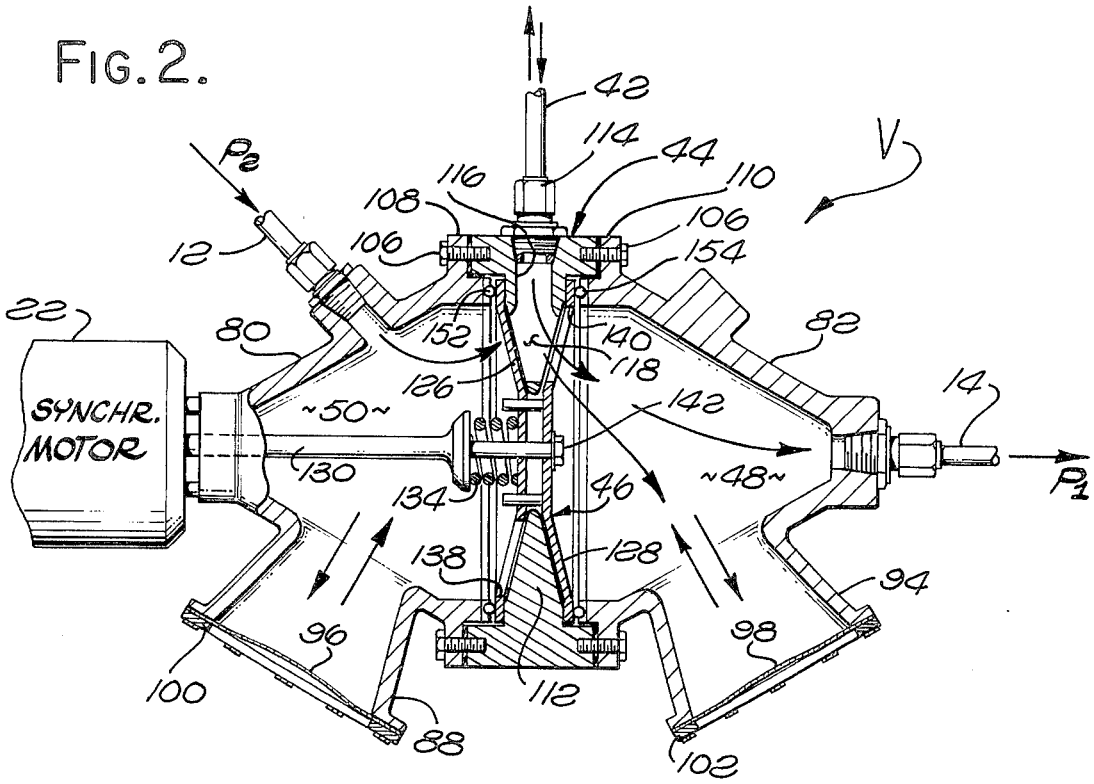

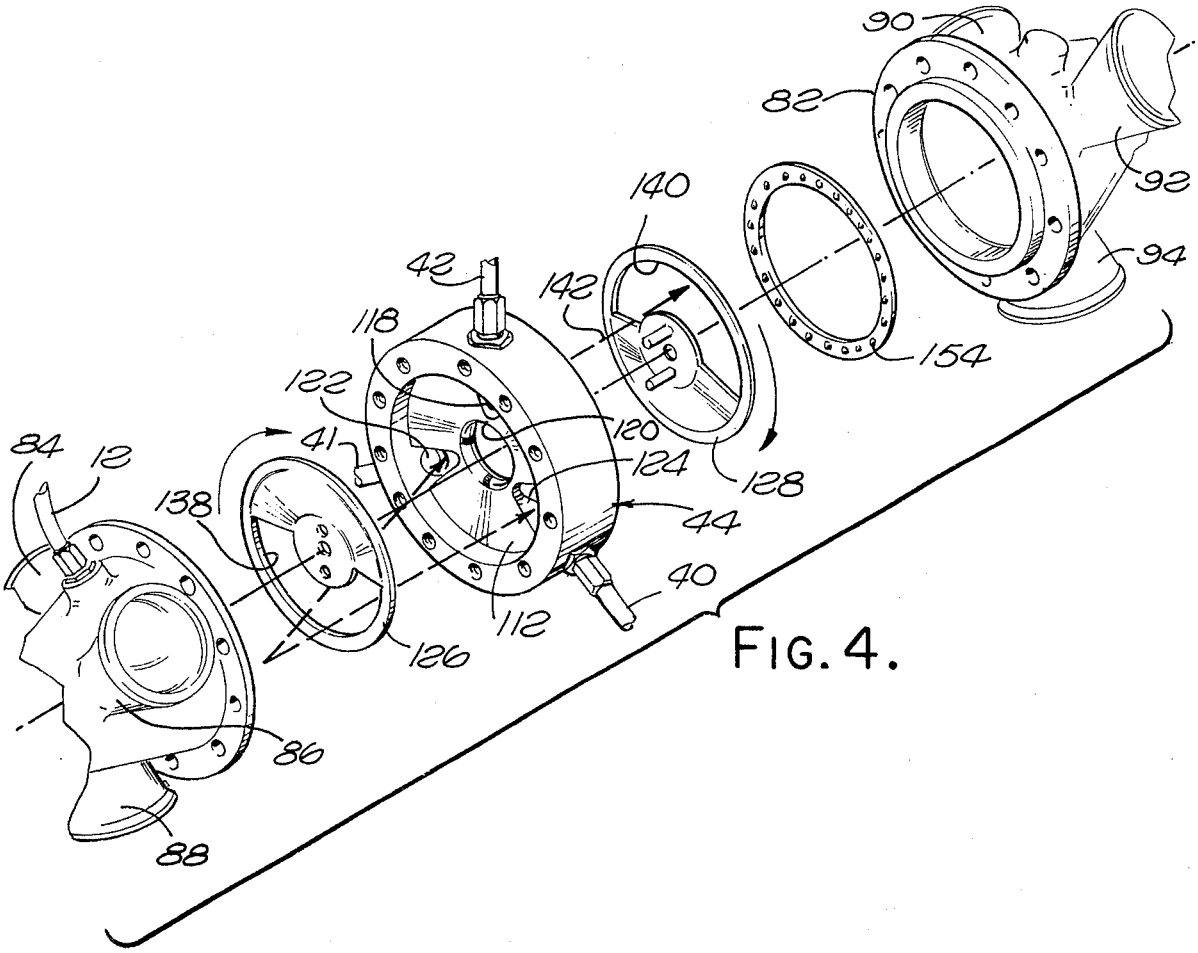
FIG. 4.
FIG. 6.
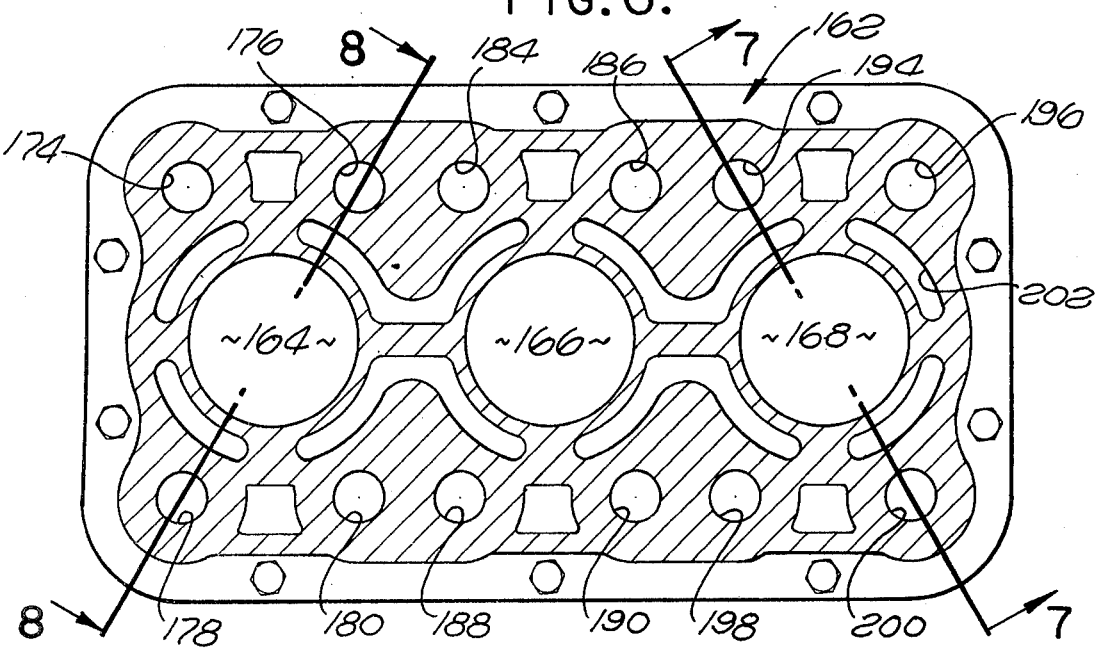

FIG. 13.
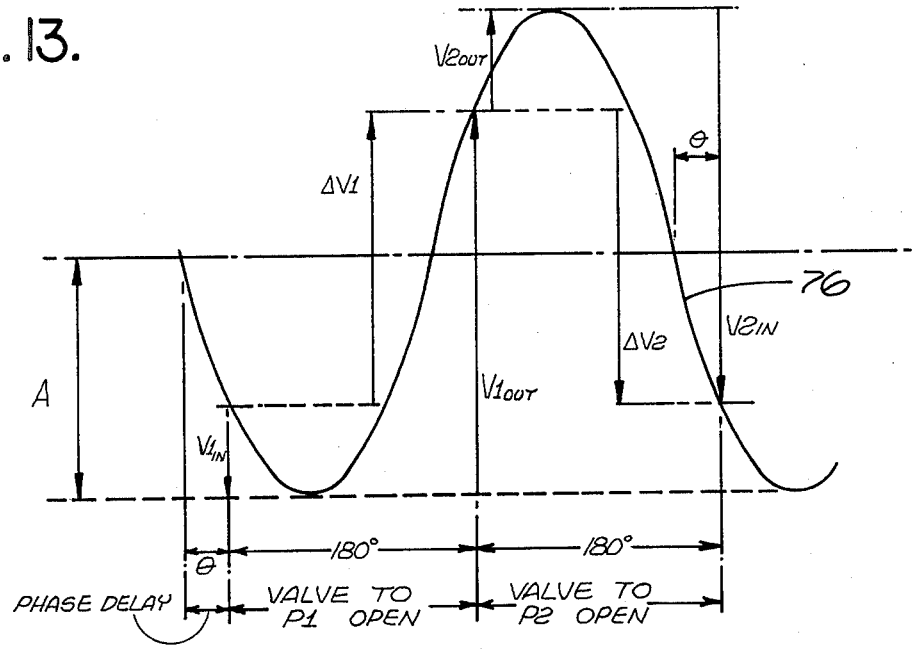
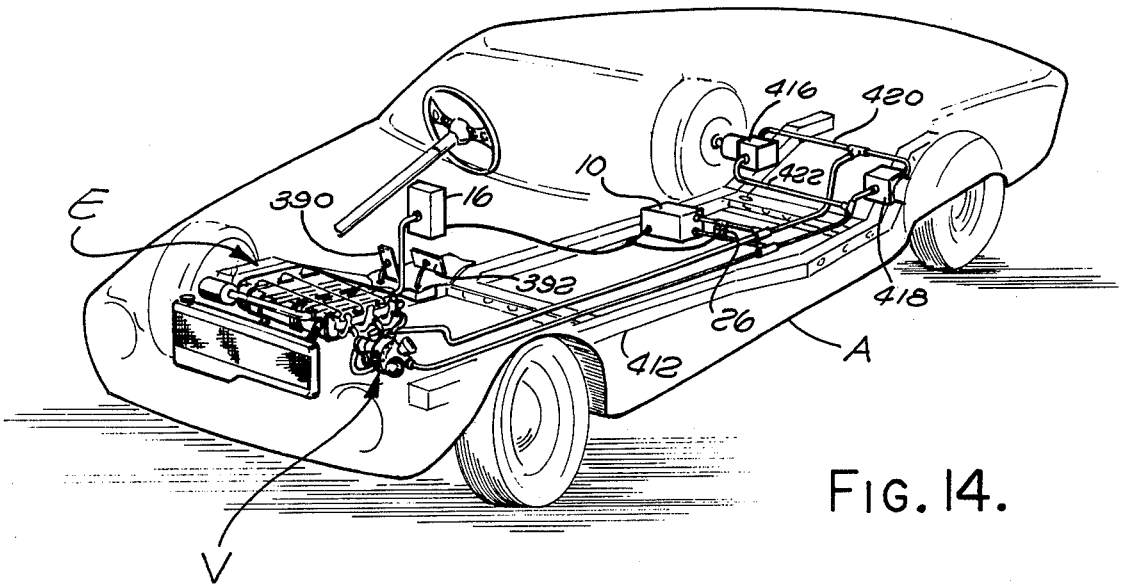
FIG. 14.

MULTIPLE-PHASE COMBUSTION ENGINE EMBODYING HYDRAULIC DRIVE

BACKGROUND AND SUMMARY OF THE INVENTION

Combustion engines, and particularly engines for automotive use, have been the subject of considerable recent research. In that regard, reasonably good conventional engines are available and vast machinery exists for the economical production of such engines. However, it appears that conventional engines are approaching the stage of having been engineered to their limits with respect to minimizing fuel consumption and pollution along with the secondary considerations of noise, weight, and cost. As a consequence, the need for a substantially new engine has been recognized; however, the systems proposed to date apparently have not represented sufficient improvement to motivate the required substantial changes for meaningful production.

One type of developed engine that appears to ofter substantial advantage operates on a resonant cycle as disclosed, for example, in U.S. Pat. Nos. 3,766,399; 3,805,083; and 3,848,415 all granted to the inventor named herein. Generally, resonant engines are piston internal-combustion devices which operate with all parts moving in a rectilinear, mechanically-resonant motion pattern. Energy is stored in the resonant mechanical system (rather than in a flywheel) and may be extracted variously as by an electric generator or a hydraulic system, as disclosed in the above-referenced patents. Also as disclosed therein, combustion cycles occur selectively to maintain resonant operation of the engine as during periods of idling, and to supply power demands during drive operation. Resonant engines and related structures as disclosed in the above-referenced patents as well as pending applications Ser. No. 375,374 (July 2, 1973) and Ser. No. 413,070 (Nov. 5, 1973) and further in accordance with the developments of the present invention offer substantial advantages with respect to various current considerations as will now be specifically treated.

In considering the importance of various characteristics for combustion engines, fuel consumption (efficiency) must be rated as very significant. Conventional internal-combustion engines (Otto cycle) which are in widespread use are quite inefficient, particularly both with respect to combustion and expansion during operation at high and low levels of power output. Although stratified charge engines and Diesel engines are capable of improved efficiency, the lateral forces inherent in such engines as they are conventionally constructed result in high frictional losses to limit the efficiency of operation. Contrasting these considerations relating to conventional engines, the resonant engine as embodied in the present system operates at a substantially constant frequency with the consequence that the engine can be optimized as an element of the design. Additionally, due to solely rectilinear motion patterns, the engine hereof does not involve lateral forces and as a consequence it is capable of operation with a substantially reduced friction load. As another characteristic relating to fuel economy, the engine as embodied in the present system burns fuel only during active combustion cylces which are initiated only when required either to maintain operation of the engine or to supply current demands for power. As a final consideration relating to fuel economy, the present system incorporates dynamic braking to further conserve energy and fuel.

The volume of pollutants that are produced by a combustion engine is another very important factor in evaluating engines for further widespread use. In that regard, it is initially noteworthy that improved engine efficiency results in the consumption of less fuel and an attendant proportionate reduction in the volume of the products of combustion, which may or may not include serious or harmful environmental pollutants. In any event, with respect to any particular form of engine, or system, the less fuel consumed, the less will be the quantity of pollutants that are contributed to contaminate the environment.

Further with regard to environmental polluting emissions, the system of the present invention may be designed for optimum resonant operation to obtain substantially consistent correct combusion. The system may be further improved in that regard by operating a Diesel cycle so as to produce relatively few serious pollutants. As a related matter, the relatively large size and weight of conventional Diesel engines may be avoided in systems of the present invention as a result of the sinusoidal linear motion patterns which are free of the lateral stresses that necessitate the heavy structures characteristic of conventional Diesel engines.

Another important aspect of the motive system of the present invention involves a considerable improvement over conventional Diesel engines in acceleration capability. This is, in accordance with the present system, acceleration may involve little change in the momentum of the resonant engine; and additionally effective control of combustion patterns permits a transition from miminum power output to maximum power output during the period of a single cycle of the engine.

In addition to the various aspects of engine performance, as treated above, another very important criterion concerns the cost required to obtain the production of engines in substantial numbers. In that regard, structural simplicity is an obvious benefit. Another distinct consideration is the degree to which an engine may utilize conventional components, e.g. pistons, valves, cooling apparatus and so on. Still another aspect relates to the requirements of the engine for ancillary apparatus, e.g. exhaust devices for pollutant control, noise control apparatus, or specical equipment as the fuel injection pumps for certain forms of Diesel engines. The system of the present invention represents a substantial improvement with respect to these considerations.

In general, the present invention integrates a resonant, multiple-phase combustion engine having hydraulic output, with a dynamic valving unit for the cooperative operation of one or more hydraulic motors. The system further integrates control apparatus to vary the mechanical output, which includes negative drive power, i.e. braking, during which operation the kinetic energy of the driven system, e.g. automobile, supplies power through the hydraulic motor and the dynamic valve to be stored by the resonant engine.

BRIEF DESCRIPTION OF THE DRAWINGS

The drawings, disclosing an illustrative embodiment of the present invention and which serve to present the various objectives and advantages hereof, are as follows:

FIG. 2 is a sectional view taken vertically through a valve component of the system of FIG. 1;

FIG. 3 is a sectional and diagrammatic view of an illustrative single-phase system, which is useful in explaining the present invention;

FIG. 4 is an exploded view of the structure illustrated in FIG. 2;

FIG. 6 is a sectional view taken along line 6—6 of FIG. 5;

FIG. 13 is a graphic representation of the operation of the system of FIG. 1; and FIG. 14 is a perspective view of the system of FIG. 1 integrated into an automobile.

DESCRIPTION OF THE ILLUSTRATIVE EMBODIMENTS

As indicated above, detailed illustrative embodiments of the invention are disclosed herein. However, embodiments may be constructed in accordance with various other forms, some of which may be rather different from the disclosed illustrative embodiments. Consequently, the specific structural and functional details disclosed are merely representative, yet in that regard they are deemed to provide the best embodiments for purposes of disclosure and to establish a foundation as a basis for the claims which define the scope of the present invention.

Figure 1:
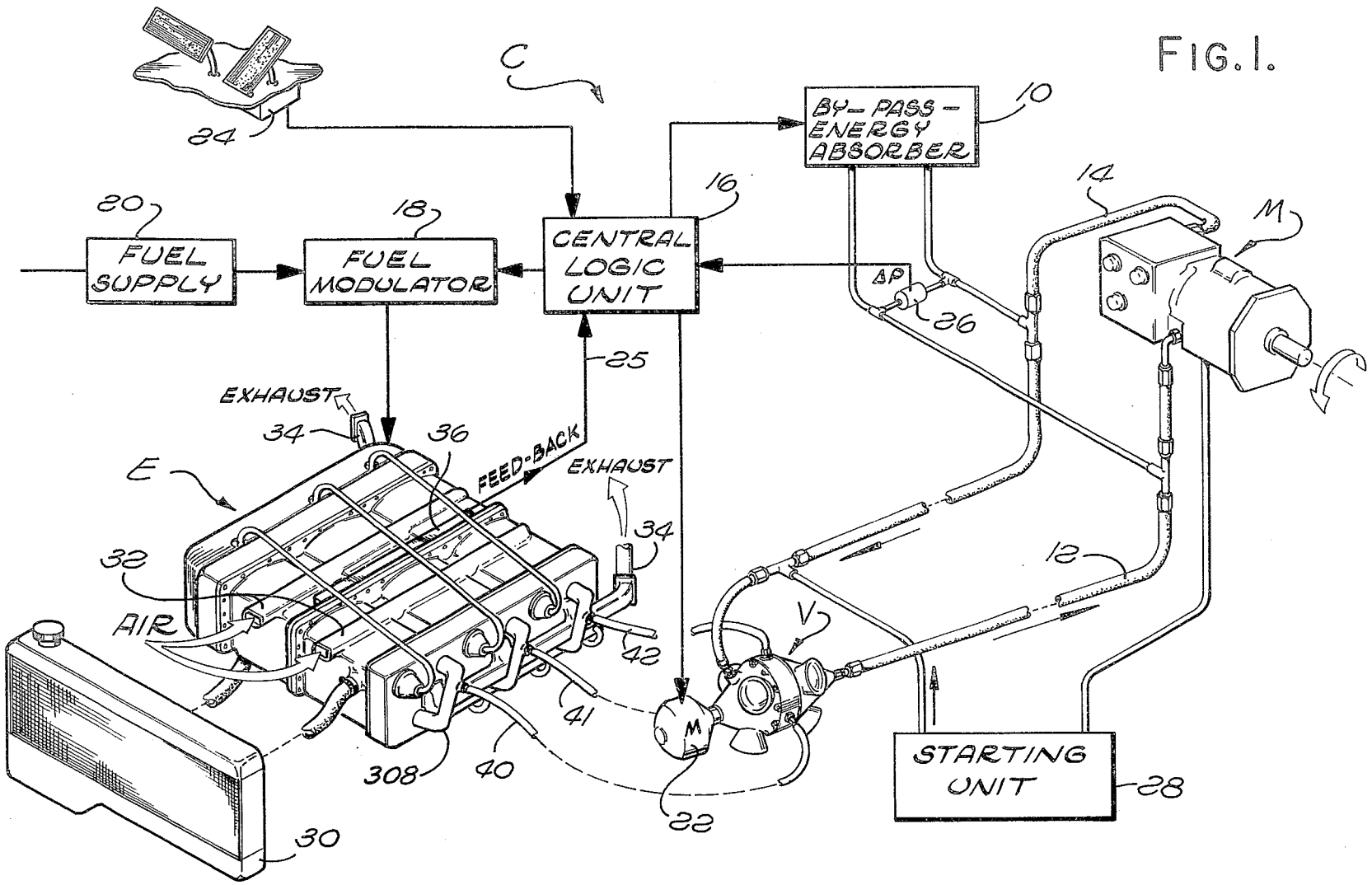
FIG. 1 is a perspective and diagrammatic view of a motive system constructed in accordance with the present invention.

Referring initially to FIG. 1, an engine E is illustrated which consumes fuel to provide phase-displaced alternating hydraulic energy in three lines that are connected to a dynamic valve unit V. Synchronism is preserved between the operation of the valve unit V and the engine E so that the valve functions as a converter to provide a unidirectional fluid stream for actuating a motor M. In that regard, although a single hydraulic motor M is illustrated, it will be appreciated that various forms and various numbers of hydraulic motors may well be employed in systems of the present invention, as disclosed below.

By reason of the couplings between the individual components of the system of FIG. 1, as described in detail below, in one operating mode, energy flows from the engine E through the valve unit V to drive the motor M. That energy path is controlled in accordance with commands from a control apparatus (incorporating manual control) and generally designated at C. That is, energy from the engine E is provided to the motor M on a demand basis, the engine E burning fuel to supply such a demand, and additionally to store a quantity of energy in the engine E.

The motor M, in addition to functioning as a drive unit also may operate as a source of hydraulic energy (pump) during a dynamic-braking mode of operation. That is, during periods when it is desired to brake the mechanical system associated with the motor M, as a vehicle for example, the motor M operates as a pump (regulated by the control unit C) so as to supply energy through the valving unit V for storage in the engine E. In that manner, dynamic braking is performed in an energy-conserving mode.

Treating the system in somewhat greater detail, the situation may arise in which it is desirable to provide additional braking for the mechanical system associated with the motor M, e.g. an automobile. Such braking is accomplished by the use of a bypass energy absorber 10 which is connected between the intake and exhaust lines 12 and 14, respectively, for the motor M. The energy absorber 10 is controlled, as indicated, by a central logic unit 16, which also performs other control functions. Specifically, the unit 16 also controls a fuel modulator 18 for supplying fuel to the engine E from a fuel supply 20. Furthermore, the unit 16 controls an electric motor 22 which drives the dynamic valve unit V.

The control functions of the central logic unit 16 are based upon information received from several sources. Demands for energy transfers to and from the motor M are primary and are indicated by a manual control 24. The energy currently stored by the engine E is also a factor of control. In that regard, an indication of the energy is provided from the engine E to the logic unit 16 through a line 25. As another input, the unit 16 receives an indication of the pressure differential between the lines 12 and 14 from a pressure sensor 26 which is coupled between those lines. In essence, the central logic unit 16 of the control apparatus C operates and controls the engine E, and the valve unit V in such a manner as to sustain the engine operational (as during idling intervals) and to efficiently supply, and withdraw, energy with respect to the apparatus powdered by the motor M. Somewhat ancillary to the basic operation of the system of FIG. 1, a starting unit 28 is connected to the high pressure line 14 for initially actuating the system to establish an operational state.

Considering the individual components of the system of FIG. 1 in somewhat greater detail, the engine E is a piston internal-combustion device operative in rectilinear, resonant motion patterns. Energy is stored in the mechanically resonant system of the engine E (rather than, conventionally, in a flywheel) and, in the disclosed embodiment energy is extracted hydraulically on demand. The control apparatus C maintains a balance between the average energy provided discontinuously by active combustion cycles of the engine E to the resonant energy tank, and the energy extracted continuously from that tank. Each active cycle is constant and the average power is regulated by a controlled blending of active or scheduled power cycles and skipped or missed cycles.

Structurally, the engine E is embodied as a triphasic six-cylinder unit operating in a Diesel cycle. The engine E is cooled by a cooling system 30 circulating liquid coolant through a jacket (not shown in FIG. 1). Air is supplied to the engine E at a pressure somewhat above atmospheric pressure through intake passage structure 32 (incorporating a blower-scavenger) and the gaseous products of combustion are eliminated through exhaust passage members 34. The amplitude of current displacement of the reciprocating pistons in the engine E is indicated by a magnetic sensor 36 as a representation of the energy actually stored as a result of the resonant operation of the engine E. Such information is supplied in the form of an electrical signal through the line 25 to the central logic unit 16.

The output from the engine E (as well as the input thereto during the dynamic braking mode of operation) is provided through three hydraulic lines 40, 41, and 42 which are connected in radially spaced relationship to the valve unit V. The pressure variations in the lines 40, 41, and 42 are substantially sinusoidal and phase-displaced by 120° thus the energy coincides somewhat to the common form of three-phase electrical energy.

In the operation of the system, the valve unit V receives the three phase-displaced streams (lines 40, 41, and 42) and converts that three-phase hydraulic energy to a stream of unidirectional (direct current) hydraulic energy which actuates the motor M through the lines 12 and 14. As will be disclosed in detail below, the valve unit V functions not only as a flow converter but additionally accomplishes a control function in response to commands by the central logic unit 16. Specific control is exercised by varying the phase of the synchronous motor 22 in relation to the operation of the resonant engine E.

As a general comment, it is perhaps noteworthy that although the hydraulic aspect of the system may be embodied in an electrical form, certain weight advantages exist which favor the hydraulic system. Additionally, the hydraulic system inherently incorporates a lubricant. Also, the current state of hydraulics readily accommodates the system embodied to function at relatively high operating pressures, which enable high efficiency.

Turning now to a detailed consideration of the components of the system, a sectional view of the valving unit V appears in FIG. 2 showing the lines 12 and 14 through which the unidirectional stream flows. Representative of the multiple-phase (three) somewhat sinusoidal inputs is the line 42. The connections of the lines 40, 41, and 42 are spaced at 120° about the circumference of an annular housing 44 just as the hydraulic energy in those lines is phase displaced by 120° and so maintained as described in detail below.

Inside the annular housing 44, a rotary valve member 46 is mounted for revolution by the motor 22. Essentially, the valve member 46 is driven in synchronism with the resonant engine E (FIG. 1) so that during a drive mode positive pressure variations in the lines 40, 41, and 42 are accommodated by permitting the flow of fluid to the chamber 48 under average pressure $P_1$. Similarly, during part of the decreasing pressure excursions, fluid is permitted to flow from the opposed chamber 50 (under average pressure $P_2$) into appropriate of the three-phase lines, e.g. line 42. Essentially, the flow patterns are similar during both the drive and braking modes of operation; however, energy is transferred from the engine E to the motor M during drive intervals (when $P_1$ exceeds $R_2$) and flows in the reverse direction during braking intervals (when $P_2$ exceeds $P_1$) in accord with the direction of the pressure differential.

Analogizing again to electrical equivalents for purposes of explanation, the valve unit V functions somewhat as the hydraulic equivalent to a synchronous electrical converter. The valve unit V also controls the fluid flow by phase displacement in the valving. In that sense, the function is somewhat similar to that of a silicon-controlled rectifier (SCR) in an electrical system. An understanding of the operation of the valving unit V now may be best advanced by considering the operation of a single phase as illustrated in FIG. 3.

A single power piston 52 is represented for reciprocal motion in the cylinder 54. Valves 56 and 58 are illustrated coupled to the piston 52 to supply the flow of fuel or the like for reciprocating the piston 52. Of course, combustion means may also be provided as well known in the prior art. Essentially, various forms of cycles might be employed, e.g. Otto, Diesel, stratified charge, and so on to reciprocate the piston 52 within the cylinder 54 in a resonant motion pattern which involves the storage and release of energy by a spring 60 and the mass in motion. The power piston 52 is directly connected to a hydraulic piston 61 by a rod 62. While the power piston 52 is representative of an engine piston, the hydraulic piston 61 (during the drive mode) operates in the cylinder 64 to provide a pumping action for supplying energy through the valving apparatus 66 to a hydraulic motor 68. As indicated by a dashed line 67, the valves 56 and 58 are coupled for synchronism with the rod 62 and the valving apparatus 66.

In the operation of the system represented in FIG. 3, the integral pistons 52 and 61, along with the related hydraulic apparatus, may be considered analogous to a source of alternating electrical energy. In that regard, the mass of the pistons 52 and 61 may be likened to electrical inductance while the spring 60 may be compared to electrical capacitance. These are the elements for oscillation, and in the mechanical system of FIG. 3 the pistons 52 and 61 oscillate at resonant frequency. The consequence of the resonant oscillation is the provision of alternating hydraulic energy in the line 69 which is connected to the valving apparatus 66.

The valving apparatus 66 operates as indicated with respect to the valve unit V (FIG. 1), functioning basically as the equivalent of an electrical full-wave rectifier when fluid flow in the system is at maximum. In that regard, the filtering or smoothing of pressure fluctuations is performed by accumulators 70 and 72. The valving apparatus 66 incorporates a rotary valve member 74 which is driven in synchronism with the resonant motion of the piston 52 so as to convert alternating or oscillatory hydraulic energy to unidirectional hydraulic energy for actuating the motor 68.

During intervals of maximum fluid flow (full speed of motor 68) at the time of the power stroke of the piston 52 (away from the head) hydraulic fluid is forced under pressure from the cylinder 64 through the line 69 and the valve apparatus 74 into the accumulator 70 for supplying a substantially continuous stream to the motor 68. During that interval, exhaust fluid from the motor 68 is accommodated in the accumulator 72. During the return stroke of the piston 52, the accumulator 70 is isolated from the line 69, but continues to supply fluid to the motor 68. Concurrently, the accumulator 72 is coupled to replenish the cylinder 64 with fluid through the line 69 preparatory to another power stroke. As the capacity of each of the accumulators 70 and 72 is relatively large compared to the volume of the cylinder 64, the stream supplied to the motor 68 is quite constant. Of course, multiple-phase units result in more constant outputs, as with the electrical equivalent of multiple-phase power.

In the operation of the system of FIG. 3, by selectively powering the piston 52 and by varying the phase of the valve member 74 with respect to oscillations of the resonant piston 52, fluid flow, and energy flow patterns may be controlled such that energy flows from the apparatus of the piston 52 to the motor 68 or in the reverse direction. Essentially, energy flow from the resonant system including the piston 52 to the motor 68 occurs when $P_1$ exceeds $P_2$, as described above. For the reverse flow, the pressure $P_2$ in the accumulator 72 is developed to exceed that of $P_1$ in the accumulator 70. Accordingly, the flow of energy is reversed, i.e. from the motor 68 to the piston 61. Such a flow pattern occurs during braking intervals when energy is transferred from the motor 68 to the resonant engine, e.g. piston 52. Concerning the regulation of fluid flow through the motor 68, it may be seen that by advancing the phase of the valve member 74 with respect to the piston 61, the pressure $P_1$ may be applied to drive the piston 61 during part of the return stroke. As a consequence, the directional flow of fluid is partly reversed and only the difference goes to the motor 68. It may therefore be seen that the phase relationship as indicated above may be effectively employed as a control of the fluid flow through the motor 68 regardless of the direction of the energy flow.

Considering operation of the illustrative structure of FIG. 3 somewhat more precisely, some mathematical analysis may be helpful for a complete understanding. The following conventions will be employed which may be related to the graphic presentation of FIG. 13:

$V = A(\sin \omega t)$ = instantaneous operating volume of cylinder 64

$V_o$ = volume of fluid pumped out of cylinder 64

$V_i$ = volume of fluid returned to cylinder 64

$\theta$ = the phase displacement between the sinusoidal resonant motion of piston 61 and the revolving motion of valve member 74.

In relation to the operation of the piston 61, the synchronized rotating valve member 74 opens a passage from the accumulator 70($P_1$) to the cylinder 64 during the interval of $\omega t = \theta$ to $\omega t = \theta + 180°$. Acess from the accumulator 72 ($P_2$) is provided from the time $\omega t = \theta + 180°$ to the instant when $\omega t = \theta + 360°$.

In view of these operating parameters, the following will be apparent. In pumping out:

$$V_1\text{in} = A - A(\sin \theta) = A(1 - \sin \theta)$$

$$V_1\text{out} = A + A(\sin \theta) = A(1 + \sin \theta)$$

Thus, $$\Delta V_1 = V_1\text{out} - V_1\text{in} = 2A \sin \theta$$

In return of spent fluid:

$$V_2\text{out} = A - A(\sin \theta) = A(1 - \sin \theta)$$

$$V_2\text{in} = A + A(\sin \theta) = A(1 + \sin \theta)$$

Thus, $$\Delta V_2 = V_2\text{out} - V_2\text{in} = -2A \sin \theta$$

Accordingly, $$\Delta V_1 = \Delta V_2$$

The above analysis establishes the general case of the flow through the system. It is evident that fluid flow through the hydraulic motor is proportional with $\sin \theta$ and therefore any amount of fluid, from $\Delta V = 0$ to $\Delta V = 2A$, can be pumped during each cycle of piston 61. During intervals when the phase angle $\theta$ is made negative, the flow path is inverted with the result that pumping is from $P_1$ (accumulator 70) to $P_2$ (accumulator 72) rather than from $P_2$ to $P_1$. As a consequence, rotation of the motor 68 is reversed.

The work performed by the hydraulic piston 61 through fluid flowing from the cylinder 64, during the interval when the cylinder communicates with the accumulator 70 ($P_1$) is:

$$W_1 = -P_1V_1\text{in} + P_1V_1\text{out} = P_1(V_1\text{out} - V_1\text{in}) = P_1\Delta V_1$$

During the interval when the cylinder 64 communicates with the accumulator 72 ($P_2$) the work expression is:

$$W_2 = P_2V_2\text{out} - P_2V_2\text{in} = P_2(V_2\text{out} - V_2\text{in}) = P_2\Delta V_2$$

Since $\Delta V_2 = -V_1$, it may be concluded that:

$$W_2 = -P_2\Delta V_1$$

Thus, the total work performed during a complete cycle may be expressed as:

$$W = W_1 + W_2 = (P_1 - P_2)\Delta V_1.$$

It may therefore be seen from the above mathematical expressions that work is produced by the engine when $P_1$ is greater than $P_2$ while work or energy is received and stored or absorbed by the engine when $P_1$ is less than $P_2$. Of course, it will be apparent to one skilled in the art that these mathematical statements follow from a physical consideration of the representative system of FIG. 3. That is, at a time when the pressure ($P_1$) in the accumulator 70 is greater than the pressure ($P_2$) in the accumulator 72, energy will be transferred from the piston 61 and cylinder 64 to the motor 68. conversely, at a time when the pressure ($P_2$) in the accumulator 72 exceeds the pressure ($P_1$) in the accumulator 70, energy will be transferred from the motor 68 (now functioning as a pump) to the cylinder 64 and the piston 61. Variations of the phase angle $\theta$ control the fluid flow and only indirectly the energy flow, as is explained below.

The operation of the system as depicted in FIG. 3 may be considered analytically with reference to the graph of FIG. 13. In that regard, the motion of the piston 61 is essentially sinusoidal as represented by the curve 76. Intervals during which the valve member 74 is open to the accumulators 70 ($P_1$) and 72 ($P_2$) are indicated along with a phase delay $\theta$ with reference to cross-over points of the curve 76. The amplitude of the volume resulting from piston displacement is indicated by the letter A. Various specific volumes are also indicated in the diagram.

Considering the work performed by the piston 61 (FIG. 3) to a further degree, the assumption can be made that the pressures $P_1$ and $P_2$ are substantially constant during any one stroke of the piston. The assumption is reasonable because, as previously indicated, the volume of the hydraulic cylinder 64 is substantially smaller than the individual volumes of the accumulators 70 and 72.

Thus, as suggested above, the energy or work is positive when delivered by the piston 61 and negative when absorbed into the system through the piston 61. In operation, the control system including the central logic control unit 16 (FIG. 1) as described in detail below, adjusts the phase delay $\theta$ until the average flow $Q_{avg}$ through the valving apparatus 66 (FIG. 3) coincides to the flow Q through the motor 68. Stated mathematically, $Q_{avg} = Q = K\omega_R$ where $\omega_R$ is the angular velocity of motor 68 and $K$ is a constant but: $Q_{avg} = \Delta V$(frequency) which is the total volume flowing per second or: $Q_{avg} = (2A\sin\theta)f$ thus: $Q = K\omega_R = 2Af(\sin\theta)f$ as A and $f$ are constant, $\omega_R = 2Af(\sin\theta)/K = K'(\sin\theta)$ It may, therefore, be seen that $\sin\theta$ is directly proportional with the angular speed $\omega_R$. When such conditions prevail, the pressures $P_1$ and $P_2$ will not change. Consideration will now be given to controlling $\Delta P$ which is in fact equal to $P_1 - P_2$ and which controls the transfer of energy in the system.

Any quantity of hydraulic fluid introduced in the system can increase $P_1$ or $P_2$ depending Consequently, the location at which such additional fluid is introduced. consequently, $\Delta P$ can be controlled internally by temporarily increasing or decreasing $\theta$ and thus effecting the flow through the valve 66. If $Q_{avg}$ (through the valve) is greater than Q (flow through the motor) for a time $\Delta t$, a quantity of fluid $\Delta V_o = (Q_{avg} - Q)\Delta t$ will be pumped from $P_2$ to $P_1$, thereby decreasing $P_2$ and increasing $P_1$. Of course, the opposite consideration similarly is applicable. Summarizing, if a constant torque is desired and specified as $T = K''(P_1 - P_2) = K''\Delta P$; the logic unit alters $\sin\theta$ to match the flow through the motor and therefore maintains the existing $\Delta P$. Thus, changes in torque are achieved simply by temporarily increasing or decreasing $\sin\theta$ which moves extra fluid between the accumulators 70 and 72 to alter the differential pressure $\Delta P$. By varying the phase delay of the valve apparatus 66 with respect to the reciprocal motion of the piston 61 (as depicted in FIG. 3) both fluid flow and power control are effectively accomplished. Of course, the single phase analysis considered with reference to FIG. 3 is fully applicable to the three-phase operation of the system illustrated in FIG. 1 using the valve structure of FIG. 2.

Considering the conversion of three-phase pulsating energy as presented from the engine E (FIG. 1) in the lines 40, 41, and 42 into direct-flow hydraulic energy, the structure of the valve V (FIG. 1) as shown in greater detail in FIGS. 2 and 4 will now be explained. The valve unit V incorporates a pair of somewhat similar housing members 80 and 82 (FIG. 2) which respectively define the chambers 50 and 48. The housing members 80 and 82 are somewhat conical, however, each incorporates three radially extending chambers. Specifically, the housing 80 incorporates radial extensions defining accumulators 84, 86, and 88 (FIG. 4) while the housing 82 incorporates similar radial accumulator chambers 90, 92, and 94. Various numbers of accumulators may be employed in different embodiments; however, three such structures facilitate alignment with flow patterns. Also, perhaps it is noteworthy that a system may rely on the inherent elasticity of connections and components so as to avoid the need for any accumulators.

The similar details of each accumulator are representatively illustrated in FIG. 2, in which the accumulators 88 and 94 are shown in cross section. These units defined by the radial accumulator chambers 88 and 94, extending from the housings 80 and 82, respectively, are closed by resilient flexible plates 96 and 98 which are held in position by clamp rings 100 and 102, respectively, passing studs therethrough and into the housings 80 and 82. The operation of the radial accumulators involves distortion of the plates 96 and 98 as a form of energy storage, one function of which is to smooth variations in the unidirectional hydraulic stream flowing through the valve unit V.

The opposed housing members 80 and 82 are affixed in facing relationship by studs 106 extending through flanges 108 and 110 at the peripheries of the conical housing members 80 and 82, which studs 106 are received in the annular housing member 44. As indicated above, the valve member 46 rotates coaxially within the housing 44 to convert three-phase hydraulic fluctuations into a unidirectional stream of flow which is controlled by the phase angle of the valve member 46 with reference to the hydraulic fluctuations.

As best illustrated in the exploded view of FIG. 4, the three-phase lines 40, 41, and 42 enter radial ports in the housing 44 which penetrate a substantial distance into a valve disk 112. Specifically, for example, the line 42 is coupled through a connector 114 (FIG. 2) and a port 116 to a radial opening 118 (FIG. 4) which is closed at the central hub of the valve disk 112. Similar arrangements are provided for openings 122 and 124 in the disk 112.

A pair of rotary vane plates 126 and 128 are received within the housing 44 (FIG. 2) and carried on an axially supported shaft 130 for rotation by the synchronous motor 22. The shaft 130 receives a concentric stud 142 which passes through the plates 126 and 128 along with a coil spring 134. Accordingly, the vane plates 126 and 128 revolve on opposed sides of the disk 112 so as to selectively pass fluid from the openings 118, 122, and 124 (FIG. 4) through apertures 138 and 140, respectively, into the chambers 50 and 48 respectively (FIG. 2). It is to be appreciated that apertures 138 and 140 will maintain each of the lines 40, 41, and 42 open to chamber 48 for 180° of rotation and to chamber 50 for the other 180°. Each phase of the tri-phasic system functions like the single-phase system of FIG. 3 explained above, separated by 120°. Thus, the vane plates 126 and 128 are revolved in synchronism with the resonant motion of the engine pistons to accomplish unidirectional flow through the lines 12 and 14 (FIG. 2) as a result of three-phase hydraulic energy applied from the lines 40, 41, and 42 (FIG. 1). It is to be noted that the vane plates 126 and 128 operate against ball bearings 152 and 154, respectively, which tend to reduce the wear of moving parts in the unit. The controlled conversion of the three-phase hydraulic energy from the engine E (FIG. 1) as treated above, is accomplished by varying the phase displacement ($\theta$) of the vane plates 126 and 128 in relation to the resonant reciprocating motion of the engine E as explained in detail above in connection with a single-phase system.

Figure 5:
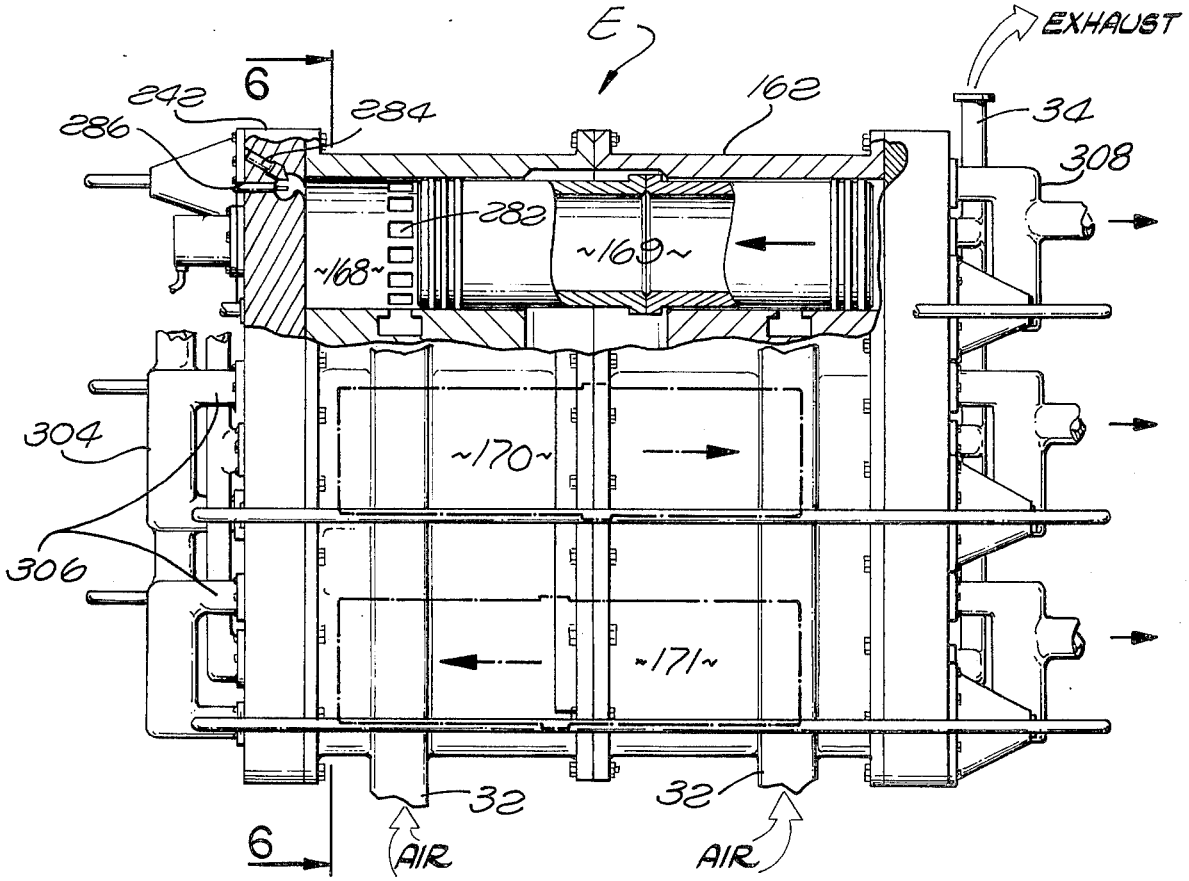
FIG. 5 is a partly sectioned view of an engine component of the system of FIG. 1.

The engine E may take a variety of different forms, two of which are disclosed herein, the first of which will now be discussed with reference to FIGS. 5, 6, 7, and 8. In FIG. 5, a plan view of the engine E is provided with one of three piston chambers, or cylinders shown in section. Each half of the engine block 162 defines three cylinder chambers 164, 166, and 168 (FIG. 6). The piston structures 169, 170, and 171 (FIG. 5) and related apparatus operating in each of the three cylinder chambers 164, 166, and 168 (FIG. 6) are substantially similar, differing only in that they reciprocate at resonant frequency and are hydraulically synchronized in 120° phase displacement.

Each of the combustion cylinder chambers 164, 166, and 168 is associated with four hydraulic cylinders. The cylinder chambers 164, 166, and 168 (FIG. 6) are the combustion chambers for burning fuel to extract energy which is delivered in the form of hydraulic fluid by piston action within the hydraulic cylinders. Specifically, the combustion cylinder chamber 164 is associated with hydraulic cylinders 174, 176, 178, and 180. Similarly, the combustion cylinder chamber 166 is associated with hydraulic cylinders 184, 186, 188, and 190. Finally, the combustion cylinder chamber 168 is associated with hydraulic cylinders 194, 196, 198, and 200. In addition to the cylinder openings described above, the block 162 also defines water-circulating passages 202 for cooling purposes as generally well known in internal-combustion engines.

Figure 9:
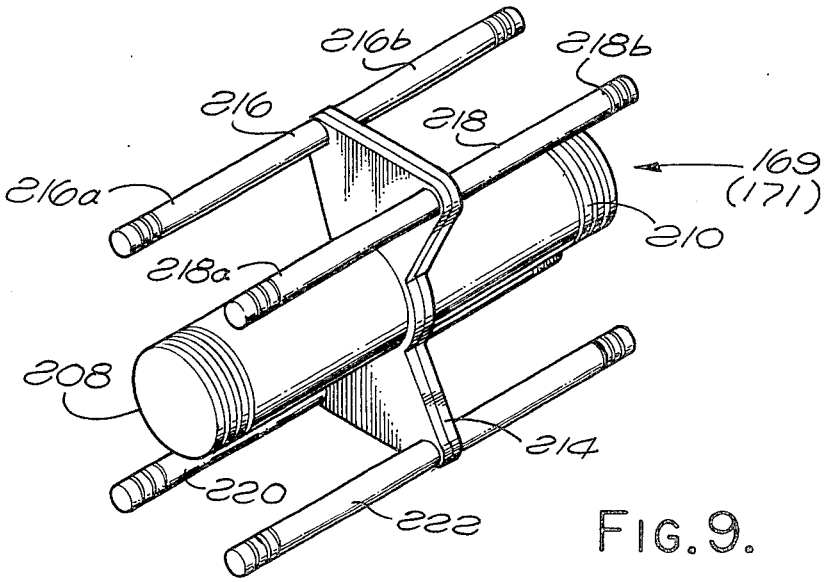
FIG. 9 is a perspective view of one component of the component illustrated in FIGS. 5, 6, 7, and 8.

The similar piston structures 169, 170, and 171 for each set of cylinders (a combustion cylinder and four hydraulic cylinders) is unitary, as illustrated by the structure 169 in FIG. 9. The engine is not to be confused with a free-piston type, although the pistons are not connected to rods or shafts for the provision of drive power. However, the high pressures which appear in the hydraulic system and the exact valving of fluid flow, which provides the drive power, constitute a positive fluid connection between the pistons of the engine and the rotary power output of motor M. On the contrary, conventional free-piston engines only provide hot gas for a gas turbine.

Each of the piston structures, exemplified by the structure 169, is double ended defining opposed combustion pistons 208 and 210. The hydraulic pistons are similarly structured for double-end operation in the hydraulic cylinders, e.g. cylinders 174, 176, 178, and 180 (FIG. 6). Referring to FIG. 9, a central bracket 214 supports four double-ended hydraulic piston members 216, 218, 220, and 222 in parallel relationship, the sections thereof substantially defining a rectangular configuration. Each of the hydraulic piston members 216, 218, 220, and 222 comprises two opposed pistons. For example, the piston member 216 defines pistons **216*a* and 216*b*. The other hydraulic piston members define pairs of pistons which are designated in a pattern as indicated above. The relationship of the piston structure 169 (FIG. 9) to the block 162 (FIG. 5) is illustrated in FIGS. 7 and 8** which will now be described in further detail.

Figure 7:
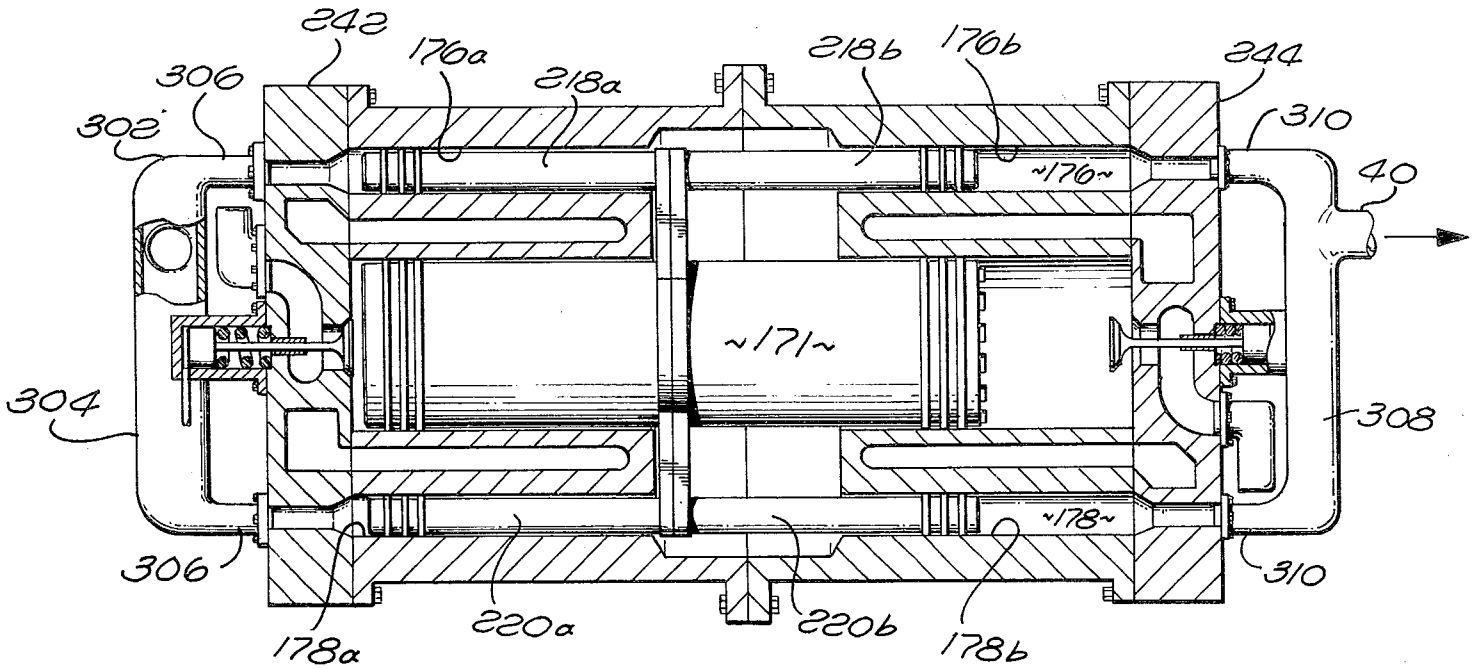
FIG. 7 is a sectional view taken along line 7—7 of FIG. 6.
Figure 8:
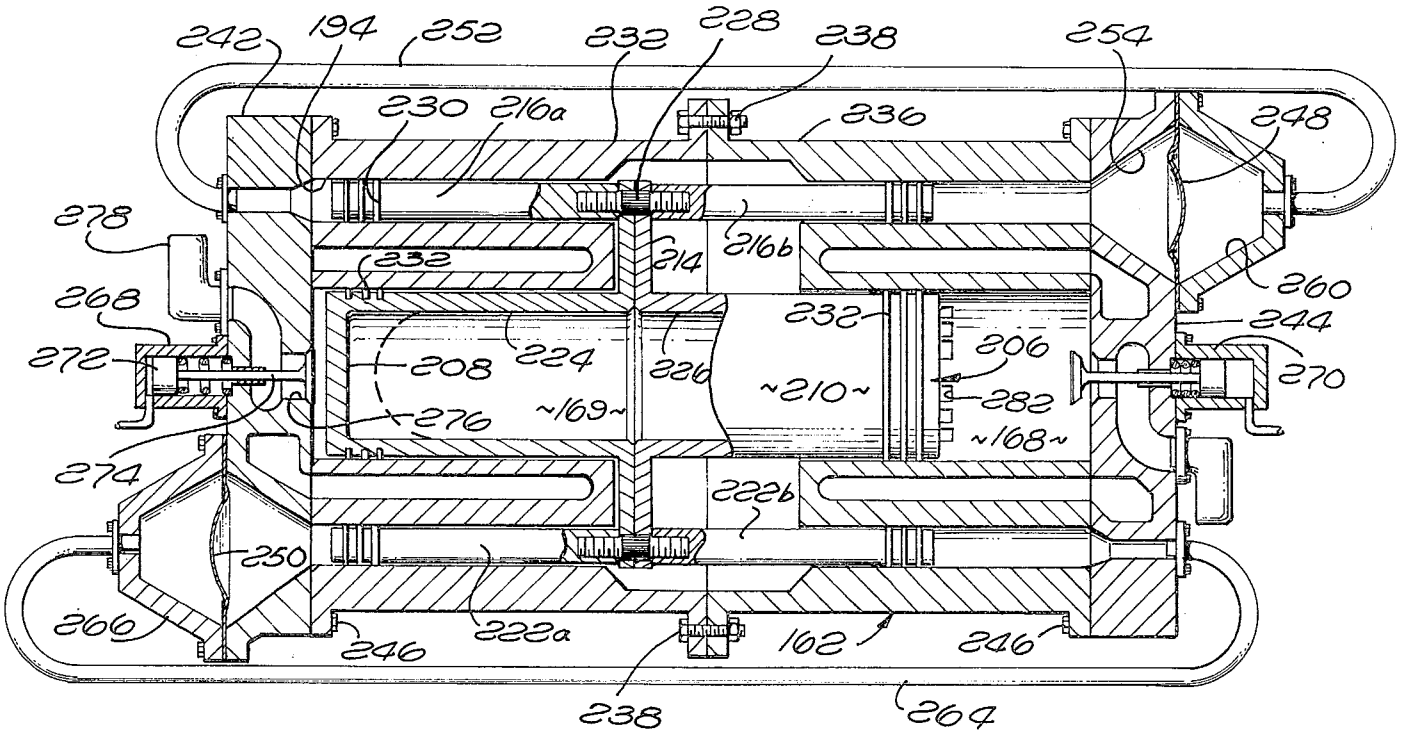
FIG. 8 is a sectional view taken along line 8—8 of FIG. 6.

For simplicity, the identification numerals applied to the piston structure 169 (FIG. 9) will be employed for discussions of that structure as it appears in the FIGS. 6, 7, and 8, recognizing that piston structures 169 and 171, distinct from each other, actually are illustrated in FIGS. 7 and 8.

The piston structure 169, as illustrated in FIG. 8, shows the piston members 216 and 222 which operate in a hydraulic system to attain a resonant motion pattern for the piston structure 169. That is, the piston members 216 and 222 develop displacement-related hydraulic forces to accomplish resonant motion for the piston structure 169. As described in detail below, the piston members 218 and 220 (FIGS. 7 and 9) function to provide the synchronized oscillating hydraulic energy affording one phase of the three-phase power output from the engine.

The piston structure 169 (FIG. 8) as illustrated actually comprises a pair of flanged cylindrical members 224 and 226 fixed together to provide the flange or bracket 214 for supporting the piston members 216, 218, 220, and 222 (FIG. 9). In that regard, doubled-ended studs 228 (FIG. 8) extend through the abutting flanges forming the bracket 214 at the rectangular corners to threadably receive opposed hydraulic pistons, e.g. pistons **216*a* and 216*b*. The individual hydraulic pistons, e.g. pistons 216*a* and 216*b*, are solid and carry piston rings 230 as well known in art. Somewhat similarly, piston rings 232 are carried by the combustion pistons 208 and 210** adjacent the closed external ends.

The engine block 162 comprises a pair of similar castings 232 and 236 (FIG. 8) affixed together by bolts 238 so as to define the internal passages as illustrated in FIG. 6. A pair of engine heads 242 and 244 (FIG. 8) are affixed to the ends of the block 162 by studs 246. Valve mechanisms are incorporated within the heads 242 and 244 along with Diesel fuel injector mechanisms. Essentially, the engine operates as a uniflow Diesel, a form of well known engine. Such operation should be apparent to one skilled in the art from the structure described to the present point. However, the operation of the Diesel combustion cycle is treated in further detail below.

Considering the hydraulic structure in further detail, as indicated above, the function of the hydraulic pistons 216 and 222 (FIG. 8) is to accomplish resilient forces for providing resonant operation. In that regard, the pistons **216*a* and 216*b* operate in cooperation with a resilient diaphragm 248 (upper right) while the hydraulic pistons 222*a* and 222*b* function in cooperation with a resilient diaphragm 250 (lower left). More specifically, the piston 216*a*, operating in the cylinder 194, pressurizes hydraulic fluid through a tube 252 to act on the external side of the diaphragm 248. The internal side of the diaphragm 248 is interfaced with the piston 216*b*. The diaphragm 248 is mounted to isolate a truncated conical chamber 254 in the head 244 from a similar chamber 256 which is defined by a cap 260.**

During an operating interval when the piston structure 206 moves to the right, hydraulic fluid is pressurized in the chamber 254, distorting the flexibly resilient diaphragm 248 to store energy which is applied (through the fluid) back to the piston **216*b* during the opposed stroke (leftward). During such a stroke (leftward) the piston 216*a* hydraulically applies a force to the external side of the diaphragm 248 again to store energy which is released during the return stroke. Thus, spring forces are provided on the piston structure 169** to attain resonant oscillation. It is noteworthy that heavy and sometimes troublesome coil spring structures are thus avoided.

The resonant forces applied by the above-described structure are balanced in the piston structure 169 by the similar forces applied through the pistons **222*a* and 222*b* which are developed with reference to the diaphragm 250. In that regard, a tube 264 connects the opposed ends of the engine with a cap 266 closing the passage just as described above with respect to the upper hydraulic resonant structure. Thus, the forces for resilient oscillatory operation are attained by the diametrically opposed piston structures 216 and 222.**

The engine E operates as a uniflow, single cycle Diesel. Intake air at above-atmospheric pressure is provided through cylinder-wall ports 282 (FIG. 8) and exhaust is controlled by hydraulically actuated valve units 268 and 270. The valve unit 268 (FIG. 8) includes a hydraulic actuator 272 for motivating a valve 274 operating in a port 276 which is coupled to an exhaust manifold 278. The valve unit 270 at the opposite end of the engine E incorporates similar elements and is operated in phase-opposed synchronism with the valve unit 268. Diesel fuel is provided at opposite ends of each cylinder 164, 166, and 168 (FIG. 6) by injectors 284 (FIG. 5). Glow plugs 286 function during starting operation.

As explained in detail below, fuel is not burned during each power stroke as in a conventional engine; rather, fuel is burned only during selected power stroke cycles on the basis that a demand currently exists for drive or sustaining energy. Considering a power-stroke cycle, as the piston structure 169 (FIG. 5) moves to the right, a charge of air enters the cylinder 168 through the intake 32 and the cylinder ports 282. At the end of the rightward stroke, the piston structure 169 moves to the left closing the ports 282, then compressing the charge of air. At or near the end of the leftward stroke, a quantity of Diesel fuel is provided through the injector 284, which fuel ignites and is burned during an expansion stage driving the piston mechanism 169 to the right in a power stroke. At the end of the cycle of reciprocation the cylinder 168 is purged or exhausted of the products of combustion through the valve unit 268 (FIG. 8). The engine E as explained above includes three piston structures, e.g. structures 169, 170, and 171, each of which is doubled ended, providing six combustion chambers for the development of power during select power strokes as just described.

The phase-displaced piston structures 169, 170, and 171 oscillating at resonant frequency provide drive power in the form of three-phase hydraulic energy. Specifically, referring to FIG. 7, the piston structure 171 is illustrated to indicate the operation of the hydraulic pistons 218 and 220. The pistons 218*a* and 220*a* (operating in cylinder sections 176*a* and 178*a*) work into a balancing fluid manifold 302 to synchronize the piston structures. Specifically, the manifold 302 incorporates connection passages 304 extending between coupling ducts 306 affixed to the head 242 for receiving streams from each of the associated cylinders, e.g. cylinders 176*a* and 178*a*. Referring to FIG. 5, of course, the positions of the piston structures 169, 170, and 171 coincide to the positions of the integral hydraulic pistons which work into the passages 304 and ducts 306, e.g. hydraulic pistons 218*a* and 220*a* (FIG. 7). In effect, these hydraulic pistons working into the closed space defined by the passages 304 and the ducts 306 hydraulically synchronize the piston structures 169, 170, and 171 in phase-locked operation. The volumes $V_1$, $V_2$, and $V_3$ each representing the space (in the passages 304, ducts 306 and cylinders, e.g. 176*a* and 178*a*) associated with the hydraulic balancing pistons for the piston structures 169, 170, and 171 establish a constant volume. Mathematically, where V indicates maximum volume displacement of the piston structures:

$$V_1 \sin \omega t + V_2 \sin(\omega t + 120°) + V_3 \sin(\omega t + 240°) = \text{constant}$$

Essentially, because the total volume for the substantially incompressible hydraulic fluid is constant, so long as the piston structures 169, 170, and 171 are reciprocating at minimum amplitude and phase displaced by 120°, such phase displacement is maintained. Such phase displacement is evident in considering the piston structures 169, 170, and 171 of FIG. 5.

Power from the engine is taken at the opposite end (head 244 FIG. 7) through three output manifolds 308. Specifically, each of the manifolds 308 includes a flanged coupling section 310 for connection through the block 244 to each of the hydraulic output cylinders, e.g. cylinder 176*b* and 178*b*. Accordingly, the three phase-displaced hydraulic power streams are provided in the output lines 40, 41, and 42 (FIG. 1).

Figure 10:
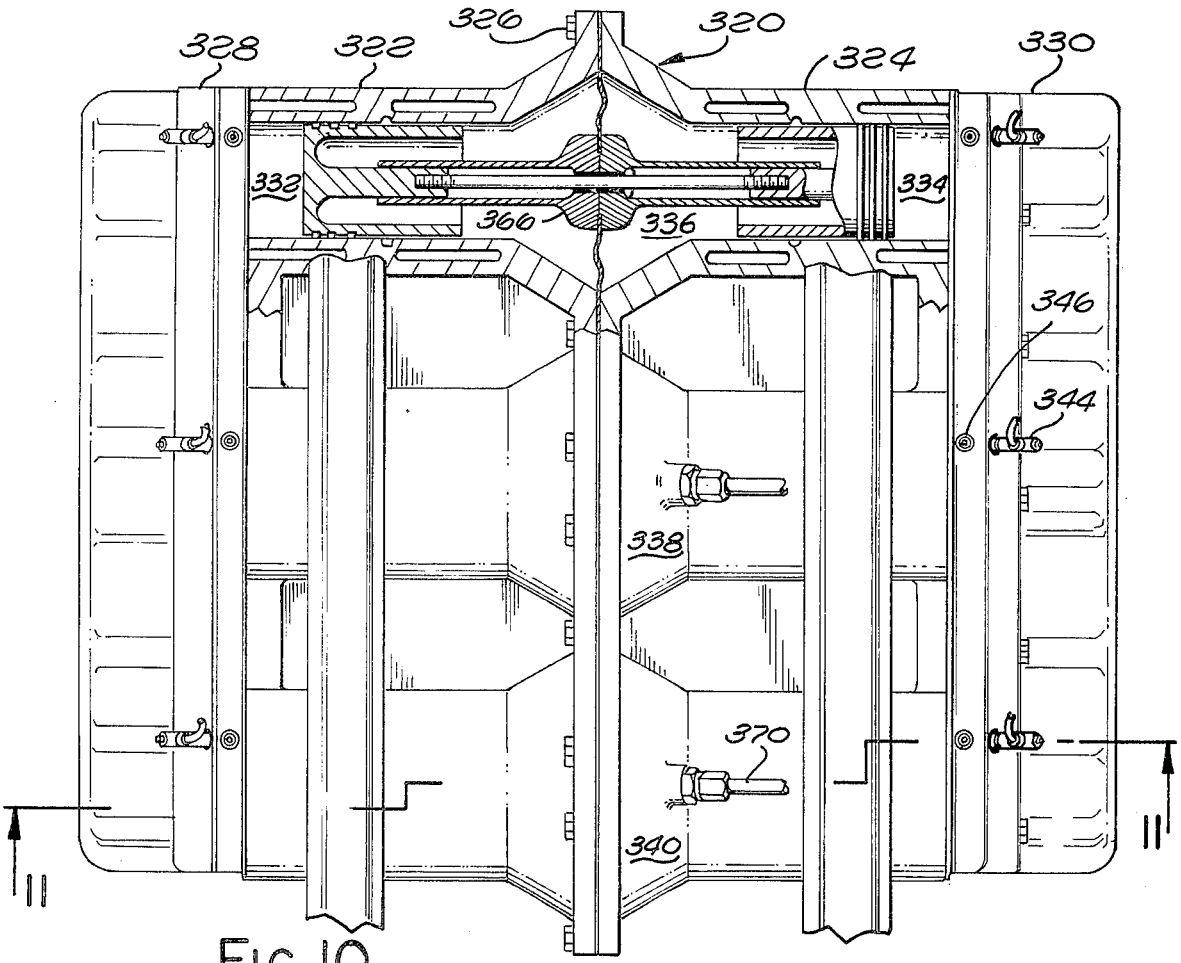
FIG. 10 is a view similar to that of FIG. 5 showing an alternative form of engine component.
Figure 11:
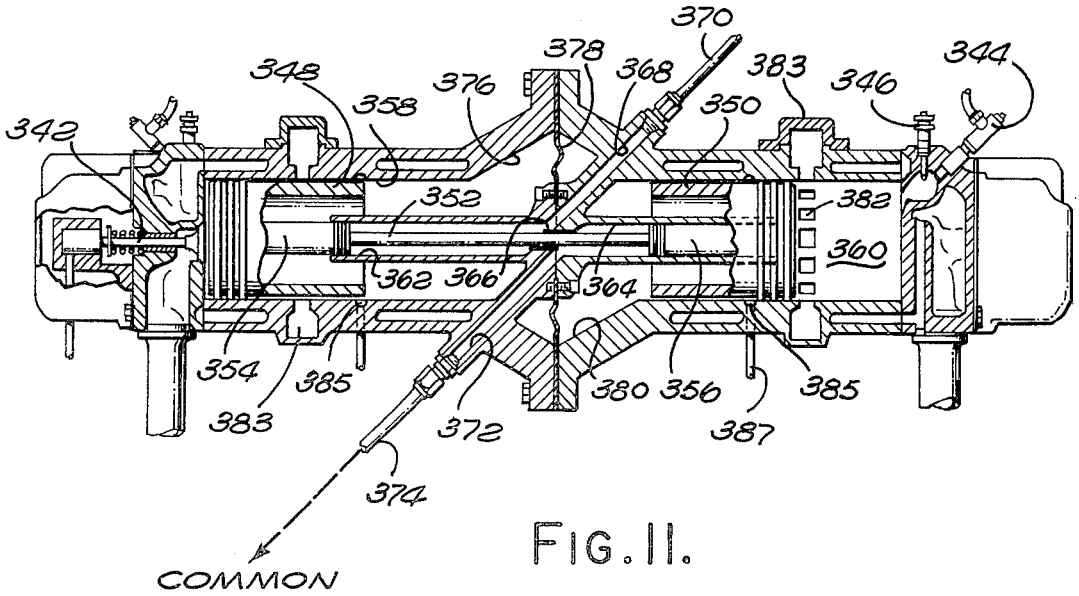
FIG. 11 is a sectional view taken along line 11—11 of FIG. 10.

As suggested above, the engine E may be variously embodied in the system of the present invention. In that regard, the engine as described above with references to FIGS. 5–9 incorporates hydraulic pistons which are axially offset from the power or combustion pistons. The engine may also be embodied in a form wherein the hydraulic pistons are axially aligned, e.g. concentric, with the combustion pistons. Such a system is illustrated in FIGS. 10 and 11 and will now be considered in detail.

A block 320 (FIG. 10) is structurally somewhat similar to that previously described, incorporating a pair of castings 322 and 324 affixed together by studs 326. The opposed ends of the block 320 receive heads 328 and 330 which close the pairs of cylinder chambers, e.g. cylinders 332 and 334. The heads 328 and 330 incorporate exhaust valves, Diesel fuel injectors, and glow plugs for each of the three engine sections 336, 338, and 340. Specifically considering the section 340 with reference to FIG. 11, an exhaust valve unit 342 is provided at each end of the section 340 utilizing hydraulic control and incorporating elements substantially as disclosed above with reference to similar structures. Diesel fuel is supplied through injectors 344 and ignited (by glow plugs 346 when the engine is cold). Thus, the opposed pistons, e.g. pistons 348 and 350 (FIG. 11) are acted upon by the combustion of Diesel fuel to accomplish oscillatory reciprocation at a resonant frequency as will now be explained.

The pistons in each of the engine sections 336, 338, and 340 (FIG. 10) are similar and will be treated in common. The combustion piston 348 (FIG. 11) in each section is connected to the combustion piston 350 by an axially aligned rod 352 terminating at threaded engagements with concentric hydraulic pistons 354 and 356 which are integral with the combustion pistons 348 and 350. Accordingly, while the pistons 348 and 350 operate in combustion cylinders 358 and 360, respectively, the hydraulic pistons 354 and 356 operate in hydraulic cylinders 362 and 364, respectively.

The rod 352 interconnecting the pistons 354 and 356 is journaled through a central slide bearing 366 to isolate the hydraulic cylinders 362 and 364. A port 368 connects the hydraulic cylinder 362 to an output line 370 which is one of the three-phase hydraulic-energy outputs. A similar port 372 connects the cylinder 364 to a line 374 from each of the engine sections 336, 338, and 340 which are interconnected to provide tri-phasic balanced operation as explained above.

As indicated above, the double-ended piston members in each of the engine sections 336, 338, and 340 (FIG. 10) oscillate at a resonant frequency. Such resonance is accomplished by providing annular resilient diaphragms to develop spring forces in cooperation with hydraulic fluid acted upon by the internal sides of the pistons 348 and 350 (FIG. 11). That is, the piston 348 closes an internal chamber 376, the internal side of which is somewhat enlarged and is closed by a resilient annular diaphragm 378. Somewhat similarly, the chamber 380, closed externally by the piston 350, is closed internally by the same resilient diaphragm 378.

As explained above, the operation of each of the engine sections 336, 338, and 340 is similar; however, the oscillations of the individual piston structures in each section are phase displaced by 120°. Again, as with the previously described engine E, the engine of FIGS. 10 and 11 is embodied as a uniflow two-stroke Diesel resonant engine and is phase synchronized by a closed hydraulic working space intercoupled by the lines, as line 374. Control is provided so that resonance is maintained and power demands are supplied by selectively introducing fuel for select power strokes. For example, referring to FIG. 11, assuming the need for additional mechanical energy, the piston 350 in the position illustrated may be assumed to have completed a power stroke and, subsequent to exhausts through valve ports, clears the ports 382 to permit the entry of a charge of fresh air, at slightly above-atmospheric pressure from the annular space 383. As the piston 350 moves to the right, the ports 382 are closed and the charge of air is compressed preparatory to the combustion of a quantity of Diesel fuel.

Concurrently, the piston 348 (moving to the right) acts upon the hydraulic fluid in the chamber 376 resiliently distorting the diaphragm 378 to store a quantity of energy which will be returned during the next stroke (leftward). Thus, the elastic forces are developed which accomplish resonant oscillation in conjunction with the mass of the piston structures.

As the piston 350 reaches the position of full displacement to the right, a stream of Diesel fuel is injected by the injector 344 and is ignited and burnt as it enters the hot compressed air. Consequently, the heat produced accomplishes an expansion which (along with the energy released from the diaphragm 378) actuates the piston 350 to the left. As the piston 350 moves to the left, the diaphragm 378 is acted upon by hydraulic fluid in the chamber 380 and is resiliently distorted to store energy for the return stroke. The piston members in each of the engine sections 336, 338, and 340 oscillate at resonant frequency phase displaced by 120° to provide the three phase-displaced hydraulic outputs to lines 40, 41, and 42 (FIG. 1) which is assured by hydraulic connections, e.g. lines as line 174.

In the operation of the engines, as described above, it is to be understood that various detailed structures as well known in the engine art may be incorporated as desired. For example, in accordance with known technology, relief grooves 385 are provided, connected to tubes 387 for accommodating by-passed fuel. Of course, it will be apparent that various other components and techniques may be incorporated in systems in accordance herewith and that the two forms of engines as disclosed are merely exemplary.

Recapitulating to some extent with regard to the total system, the engine E (FIG. 1) is controlled by selecting specific potential power cycles for the combustion of fuel to provide energy. Furthermore, control of hydraulic fluid flow is exercised as described above by varying the phase of the valving system V in relation to the engine E. These functions are accomplished, as indicated above, by the central logic unit 16 which is illustrated in block-diagram form in FIG. 12 along with blocks representative of the electric motor 22, the bypass valve 10, the magnetic amplitude sensor 36, and the pressure differential sensor 26. Additionally, a block representative of the Diesel fuel injector drivers 386 and the exhaust valve drivers 388 is illustrated. Furthermore, specific components of the manual control apparatus 24 are illustrated in the form of an accelerator pedal 390 and a brake pedal 392.

Summarily, the accelerator pedal 390 and the brake pedal 392 are employed for manual control which is exercised in combination with the current state of the system to control the phase displacement of the synchronous motor 22 and selectively command active power cycles by controlling the injector drivers 386 and the exhaust valve drivers 388. Furthermore, the bypass valve 10 is controlled to dissipate further energy as during the need for excessive braking operations. The state of the system is indicated by the amplitude sensor 36 and the differential pressure sensor 26. Control of active cycles is provided by a program mechanism 394 and phase control of the synchronous motor 22 is accomplished by a phase modulator 396. The mechanism 394 is connected to receive a signal from the amplitude sensor 36 through a line 398 indicative of the current amplitude of piston displacement. That signal is also applied through a synchronous sine wave generator 400 to the phase modulator 396. The mechanism 394 also receives informaton indicative of the pressure differential across the drive lines from the sensor 26, which information is processed through a power output detector 402, the detector being connected to receive a signal from a phase detector 404 which is indicative of sin $\theta$ and which is also applied to a digital comparator 406.

The determination of active power cycles in the individual sections of the engine is determined primarily on the basis of the amplitude of oscillation currently existing for the piston structures. Such control is exercised in cooperation with the current power output. Accordingly, the mechanism 394 receives control information from the power output detector 402 and the amplitude sensor 36. Considering some examples, if the engine is in an idling mode, with essentially no power output, relatively low levels of amplitude are permitted to occur. However, when the engine operates with a substantial power output, the level of minimum amplitude is increased. A system for exercising control in accordance with these parameters is illustrated in FIG. 6 of the present inventor's U.S. Pat. No. 3,848,415, issued Nov. 19, 1974.

Figure 12:
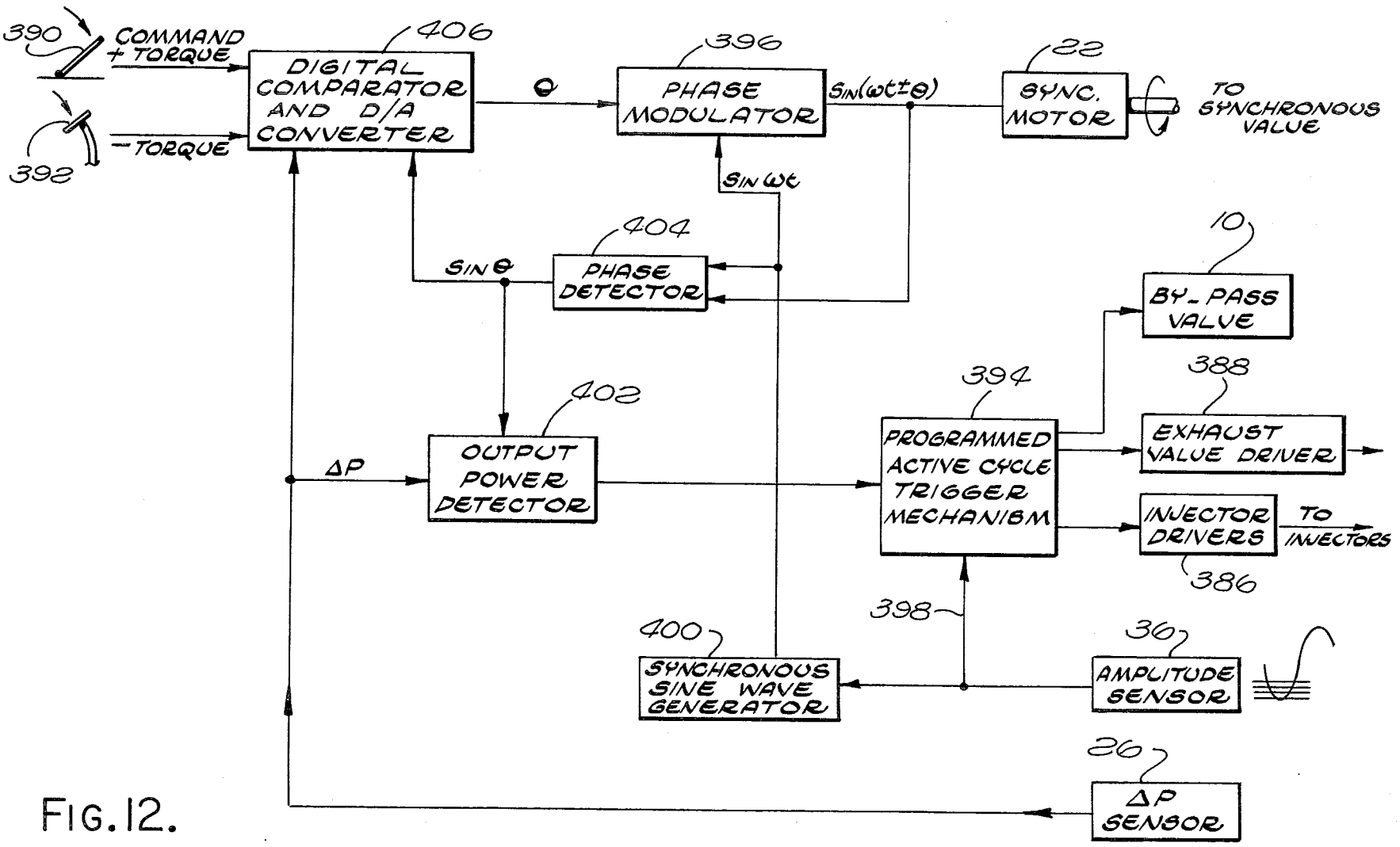
FIG. 12 is a block diagram of a control component as embodied in the system of FIG. 1.

In addition to selecting those cycles during which fuel will be burned to produce power, the system of FIG. 12 also controls the phase displacement between the valving unit V (FIG. 1) and the engine E. Such control is exercised through the synchronous motor 22 (FIG. 12). As described in detail above, the operation of the synchronous motor 22 is commanded by a signal representative of sin $(\omega t \pm \theta)$ which is provided by the phase modulator 396. Such a signal is accomplished by the modulator as well known in the prior art from input signals representative of $\theta$ and sin $\omega t$. The signal representative of sin $\omega t$ is provided from the synchronous sine wave generator 400 whih is synchronized by a signal from the amplitude sensor 36 indicative of the operator phase of the engine. The signal representative of the angle $\theta$ is provided by the comparator and converter 406. Specifically, the comparator and converter 406 receives an input from one or the other of the controls 390 or 392 indicative of desired output, which signal is compared with a pair of outputs representative of the instant situation, i.e. the pressure differential provided from the ΔP sensor 26 and the signal representative of sin $\theta$ provided from the phase detector 404. Accordingly, a comparison is provided between desired power output and present operating conditions to provide a signal indicative of the necessary angle $\theta$ which is supplied to the phase modulator 396.

As described generally above, the system has been referenced for operation in an automotive vehicle. Pursuing such as installation, reference to FIG. 14 will reveal an effective arrangement of system components within an automobile. Specifically, the external configuration of the automobile A is generally indicated with respect to a frame 412 supported upon running gear 414. As disclosed, the vehicle incorporates two independent rear-wheel drives in the form of hydraulic motors 416 and 418 which communicate hydraulically through ducts 420 and 422 with the engine E. The brake and accelerator pedals 390 and 392 are generally indicated along with the control system which is fixed in a housing 16. The valving system V is also indicated along with the differential pressure sensor 26 and the bypass energy absorber 10.

In the automotive system, as will be apparent from the above description, the engine E functions to burn fuel to provide multiple-phase hydraulic energy which is converted to a unidirectional energy stream by the valving unit V for actuating the motors 416 and 418 by supplying hydraulic fluid through ducts 420 and 422. During the course of such operation, considerable economy is attained for a number of reasons. First, the engine E burns fuel only as required in accordance with instantaneous demand. Additionally, the engine E is constructed to avoid significant lateral forces and, accordingly, the entire unit is relatively light and additionally sizable frictional forces are eliminated. Furthermore, the system effectively employs dynamic braking to provide energy which is stored in the engine E for future use. For example, during routine braking operations, the motors 416 and 418 function as pumps with the consequence that drive fluid is provided through the ducts 420 and 422 to actuate the engine E to a maximum level of amplitude displacement. As explained above, should the braking requirements exceed dynamic braking capability, as during an emergency situation, the energy absorber 10 becomes effective for further dissipation.

In view of the above, it may be seen that the system of the present invention represents a considerable advance in the art to which it relates with the consequence that many and substantial variations will be apparent to those skilled in the art. As a consequence, the scope hereof is to be interpreted in accordance with the claims as set forth below.

What is claimed is:

1. A motive system powered by combustible fuel, comprising:

block means defining at least one pair of combustion working chambers for said fuel, and at least one pair of hydraulic working chambers;

piston means including combustion piston means in said combustion working chambers and rigidly rectilinearly inter-coupled hydraulic piston means in said hydraulic working chambers;

elastic force means interposed between said piston means and said block means, said elastic force means and said piston means defining a mechanically resonant system;

hydraulic port means coupled to said hydraulic working chambes to provide and receive oscillatory hydraulic energy;

control means for supplying and burning fuel in said combustion chambers for driving said mechanically resonant system at its frequency of mechanical resonance and for maintaining said resonance during periods of varying power demand.

2. A motive system according to claim 1 including a plurality of separate piston means, each including a plurality of hydraulic piston means and a plurality of combustion and hydraulic working chambers.

3. A motive system according to claim 2 further including hydraulic intercoupling means between said piston means to preserve substantially equal phase displacement between said piston means during oscillation and wherein said hydraulic intercoupling means includes at least one of said hydraulic piston means for each of said piston means.

4. A system according to claim 1 wherein axes of said combustion piston means and of said hydraulic piston means are in offset parallel relationship.

5. A system according to claim 1 wherein said combustion piston means and said hydraulic piston means are in concentric relationship.

6. A motive system according to claim 1 including a plurality of said piston means for providing several phase-displaced oscillatory hydraulic energy sources, and further including valve means connected to said hydraulic port means and defining unidirectional flow passages; and valve control means coupled to said piston means and to said valve means for controlling said valve means to convert the phase-displaced oscillating hydraulic flow to unidirectional flow in said flow passages to exchange hydraulic energy between said oscillating and uni-directional flows.

7. A motive system according to claim 6 further including at least one hydraulic drive motor connected to receive said unidirectional-flow hydraulic power

8. A motive system according to claim 7 further including an automotive vehicle coupled to be driven by said drive motor.

9. A motive system powered by combustible fuel, comprising:

engine means for providing a plurality of phase-displaced hydraulic energy-carrying oscillations;

valve means connected to receive said hydraulic energy-carrying oscillations and defining unidirectional flow passages;

valve-actuating means coupled to said engine means for synchronous driving of said valve means to convert said hydraulic oscillations to unidirectional hydraulic flow in said unidirectional-flow passages;

means for controlling the phase relationship between the synchronous operation of said valve means and of said engine means to control the volume and direction of said unidirectional hydraulic flow.

10. A system according to claim 9 wherein said engine means includes elastic force means for defining a mechanically resonant system therein and said system further includes control means for energizing said engine to operate at the resonant frequency of said mechanically resonant system and in accordance with the power demand.

11. A system according to claim 10 wherein said engine means is tri-phasic.

12. A system according to claim 10 wherein said engine means is a Diesel engine.

13. A system according to claim 10 wherein said engine means is a reciprocating-piston engine.

14. A system according to claim 9 wherein said valve means comprises a rotary valve.

15. A valve means for exchanging various amounts of energy between oscillatory hydraulic flow and direct hydraulic flow comprising:

a valve body defining at least one oscillatory flow port adapted to be connected to receive oscillatory hydraulic energy and further defining first and second chambers each defining a unidirectional-flow port;

valve means driven at the frequency of said oscillatory flow for alternately opening said oscillatory energy port to said first and second chambers to provide unidirectional hydraulic flow energy; and meas for modulating in time the phase angle between the synchronous operation of said valving means and said oscillatory flow to control the direction and volume of said unidirectional hydraulic flow and consequently the direction and magnitude of the energy transfer between said oscillatory and unidirectional flows.

16. A valve means for two-way conversion of multiple-phase oscillatory-flow hydraulic energy to direct-flow hydraulic energy comprising:

a valve body defining a plurality of oscillatory-flow ports adapted to be connected to receive said oscillatory-flow hydraulic energy and further defining first and second chamber and direct-flow passages in them;

valving means driven synchronously with said oscillatory flow for alternately opening said oscillatory energy ports to said first and second chambers to provide unidirectional hydraulic flow energy; and means for modulating the phase angle between the synchronous operation of said valving means and said multiplephase oscillatory flow to control the volume and direction of said unidirectional hydraulic flow and consequently the amount and direction of the energy transfer between said oscillatory and direct flows.

17. A motive system according to claim 1 further including valve means connected hydraulically to said hydraulic port means and defining unidirectional flow passages; and valve control means coupled to said piston means and to said valve means to controlling said valve means to convert oscillating hydraulic flow to unidirectional flow in said flow passages to exchange hydraulic energy between said oscillating and unidirectional flows.

18. A motive system according to claim 1 wherein said block means define three combustion working chambers to provide a triphasic system.

* * * * *